United States Patent [19]

Stanislaw

[11] Patent Number: 4,926,530

[45] Date of Patent: May 22, 1990

[54] METHOD FOR MANUFACTURING NEEDLED FELTS HAVING MACHINE DIRECTION ORIENTED FIBERS

[75] Inventor: Peter P. Stanislaw, Bennington, Vt.

[73] Assignee: Morrison Berkshire, Inc., North Adams, Mass.

[21] Appl. No.: 131,996

[22] Filed: Dec. 11, 1987

[51] Int. Cl.[5] ..... D04H 5/02

[52] U.S. Cl. ..... 28/111

[58] Field of Search ..... 28/110, 111

[56] References Cited

U.S. PATENT DOCUMENTS

| | | | |
|---|---|---|---|
| 1,706,535 | 3/1929 | Marble . | |
| 2,372,484 | 3/1945 | Gould . | |
| 2,930,100 | 3/1960 | Rust, Jr. . | |
| 3,066,358 | 12/1962 | Schiess . | |
| 3,066,359 | 12/1962 | Kalwaites . | |
| 3,097,413 | 7/1963 | Draper, Jr. . | |
| 3,117,359 | 1/1964 | O'Byrne . | |
| 3,216,082 | 11/1965 | Goy . | |
| 3,287,786 | 11/1966 | Goy . | |
| 3,508,307 | 9/1970 | Dilo . | |
| 3,555,638 | 1/1977 | O'Byrne . | |
| 3,673,024 | 6/1972 | Erikson . | |
| 3,772,746 | 11/1973 | Ivanowicz | 28/110 |
| 3,837,054 | 9/1974 | Fehrer . | |
| 3,952,121 | 4/1976 | Dilo . | |
| 4,038,728 | 8/1977 | Fehrer . | |
| 4,308,640 | 1/1982 | Bulla et al. . | |
| 4,378,618 | 4/1983 | Dilo . | |
| 4,416,936 | 11/1983 | Erickson et al. | 28/111 X |
| 4,454,637 | 6/1984 | Dilo | 28/110 |
| 4,457,055 | 7/1984 | Ambrose et al. | 28/111 |
| 4,495,680 | 1/1985 | Beck . | |
| 4,536,927 | 8/1985 | Feyerl et al. | 28/110 |
| 4,651,393 | 3/1987 | Dilo et al. | 28/111 |
| 4,701,986 | 10/1987 | Gunther et al. | 28/142 |
| 4,716,628 | 1/1988 | Bacchio . | |
| 4,878,278 | 11/1989 | Hsu et al. | 28/142 |

FOREIGN PATENT DOCUMENTS

| | | | |
|---|---|---|---|
| 980556 | 12/1975 | Canada . | |
| 1105523 | 7/1984 | U.S.S.R. | 28/111 |

*Primary Examiner*—Werner H. Schroeder

*Attorney, Agent, or Firm*—Lerner, David, Littenberg, Krumholz & Mentlik

[57] ABSTRACT

A method and system for manufacturing endless needled felts having at least one layer of longitudinally-extending spiral windings of a fiber web is disclosed. The system includes first and second machines, one being utilized for applying and tacking spiral windings of a fiber web to an endless web or fabric and the other being utilized for full needling of the applied and tacked fiber web to the endless web or fabric. The first machine has associated therewith a web feeding device for feeding a fiber web having a width substantially less than the working width of the first machine, and a needling device having an operative width corresponding to the width of the fiber web. As an endless base fabric is moved in a longitudinal direction by the first machine, the web feeding and needling devices are reciprocated in unison in a direction transverse to the longitudinal direction so as to feed longitudinally-extending spiral windings of the fiber web onto the endless fabric, and to then tack the fiber web to the endless fabric to thereby hold the fiber web in place on the base fabric. After the desired longitudinally-extending spiral windings of fiber web are applied and tacked to the endless fabric, the fabric is removed from the first machine and placed onto the second machine which may comprise a conventional needle loom. The second machine includes a full-width needling apparatus having a working width corresponding to the working width of a second machine, and is operative to fully needle the applied and tacked fibrous material to the endless fabric as it is moved past the full-width needling apparatus. By providing two separate machines, one for applying and tacking spiral windings of a fiber web to a base fabric and the other for fully needling the applied and tacked fiber web to the endless fabric, a more efficient utilization is made of the more expensive, slower operating full-width needling machine.

7 Claims, 4 Drawing Sheets

METHOD FOR MANUFACTURING NEEDLED FELTS HAVING MACHINE DIRECTION ORIENTED FIBERS

FIELD OF THE INVENTION

The present invention generally relates to endless needled felts, such as those utilized in paper manufacture, and more particularly, to an improved method and system which provides for more efficient utilization of equipment and manufacturing operations for the manufacture of particular types of endless needled felts. The particular types of endless needled felts to which the present invention relates are those which have at least one layer of longitudinally-extending spiral windings of a fiber batt or web applied on and needled to an underlying endless web. The underlying endless web may be a base fabric, either alone or which itself has one or more layers of fibrous material needled thereto, or an endless web comprised of one or more layers of fibrous material needled together. The longitudinally-extending spiral windings of fiber batt or web are applied and needled to the underlying endless web so as to extend in the longitudinal direction thereof, and thus have a pitch in the transverse direction thereof. As the resulting endless needled felt is to ultimately be placed on a machine which moves in the longitudinal direction of the resulting felt, the longitudinal direction may conveniently be termed "the machine direction." Thus, it will be appreciated that the fibers of the longitudinally-extending spiral windings of fiber batt or web applied on and needled to an underlying endless web will be generally oriented in the longitudinal or machine direction of the needled felt.

BACKGROUND OF THE INVENTION

Needled felts for the papermakers' industry generally have a length ranging from about 40 feet to over 200 feet, although felts of shorter and longer lengths are produced in some instances. Typically, such felts have a transverse width from 200 to 400 inches. In producing needled felts, generally a number of separate layers of fibrous batt material are applied and needled to an endless backing or base fabric, generally of a woven material. The number of different layers typically is 2–8, depending upon the thickness of each of the layers. In the conventional manufacture of such endless felts, each of the layers is comprised of a carded fiber web or batt applied to the underlying endless fabric in a transverse, cross lapped manner, which is then fully needled to incorporate and unite the fibers to the base fabric. The carded fiber web or batt may be applied to the base fabric either directly from a cross lapping apparatus, or from rolls of tacked or pre-needled batt which have also been formed by cross lapping of a carded fiber web or batt. In a cross lapping apparatus, the carded fibers are supplied to a floor apron by means of a feeding device which reciprocates transversely over the floor apron so as to form a longitudinally-extending web having folded, cross-layed layers of fibers. The transverse width of the cross-layed fiber web corresponds to the transverse width of the endless backing or base fabric to which it is to be applied, with the carded fibers being oriented in a cross machine direction. As noted, the cross-layed fiber web can be applied to the base fabric either directly from the floor apron of the cross lapper apparatus, or can be tacked together by pre-needling and wound onto rolls which can thereafter be unwound to apply the cross-layed fiber web to the endless base fabric.

Such a conventional method of manufacture of paper machine felts requires that a transversely-extending splice be made after the layers of cross-layed batts are introduced and needled to the woven base fabric. Such a transverse slice can cause running problems in the press section of a paper machine, such as, for example, press bounce, since the splice is parallel to the press roll center line. Also, an unevenness in the surface of the finished felt can result. Still further, difficulties can arise in the tensile or machine direction strength of the resulting finished felt because of the transverse orientation of the fibers with respect to the direction of travel of the needled felt on the paper machine.

More recently, in order to overcome or minimize the aforementioned drawbacks, it has been suggested to apply to the needled felt one or more surface layers or plies of carded fiber batt which are oriented in the machine or longitudinal direction of the finished felt. In particular, it has been suggested to apply at least one layer of longitudinally-extending, overlapping spiral windings of a carded fiber web or batt with the pitch of the spiral windings extending transversely to the longitudinal direction of the finished felt. This is believed to provide a more appropriate orientation of the carded fibers in the longitudinal direction of the finished felt, which, in turn, is believed to provide for a smoother surface finish for the felt with improved machine direction tensile strength, thus minimizing or eliminating the possibility of longitudinal unevenness and/or press bounce For instance, U.S. Pat. No. 3,508,307 discloses a technique in which a carded fiber web or batt is trained about a pair of spaced feed rollers so as to form a series of side-by-side loops, which after a needling operation, may be axially pulled from the feed rollers, and thus provide an endless tubing. The resulting endless fabric consists of a plurality of narrow width, overlapping loops of a carded fiber web or batt which extend longitudinally and are transversely pitched. In the technique disclosed in U.S. Pat. No. 3,508,307, the plurality of overlapping loops are needled together by means of a stationary, transversely-arranged needle punching machine whose length is only somewhat wider than the width of the fiber web being looped around the feed rollers and, thus, significantly less than the overall width of the finished fabric. With such a technique, relatively complex equipment is required for enabling the formed tubular structure to be pulled off axially. Additionally, problems have been encountered with formation of wrinkles or other distortions in the surface quality of the resulting endless felt which can affect the running properties of such felt.

Another prior art technique for producing felts having layers of longitudinally-extending spiral windings of a fiber web thereon is disclosed in Canadian Patent No. 980,556. In accordance with the apparatus and technique disclosed in this reference, a carded fiber web or batt of narrow width is applied to an endless backing fabric by means of a feeding device which is adapted to be reciprocated throughout the width of the backing fabric as the backing fabric is driven in a longitudinal direction, so as to produce a series of longitudinally-extending spiral windings on the backing fabric. The loops of fiber batt so applied to the backing fabric are then needled thereto by means of a full-width needling machine which has a working width corresponding to the width of the finished paper machine felt. In accordance with such known technique, however, full needling of the several loops of carded fiber batts to the base fabric cannot be accomplished until the several loops have all been applied to the backing fabric. This has resulted in the shifting, at least locally, of the applied fiber web relative to the backing fabric or previously applied plies or layers, such that wrinkles and/or localized thinning/thickening has occurred.

More recently, it has been suggested in U.S. Pat. No. 4,536,927 to apply overlapping machine direction loops of a fiber web to a base fabric on a conventional needling loom having a full-width needling machine by utilizing a transversely-reciprocating web feeder together with a reciprocating needling device of a working width corresponding to that of the applied fiber batt, so that the fiber batt is tacked and held in place as it is applied to the base fabric. In this regard, the small-width needling device and web feeder are reciprocated in unison throughout the working width of the paper machine felt so that the applied batt can be tacked to the backing fabric substantially as it is applied on the backing fabric, whereby the desired joints between the various loops of the fiber batt and the backing fabric can be achieved without the formation of wrinkles or of thicker or thinner portions in the resulting paper machine felt. After the desired layer or layers of machine direction fibers have been applied and tacked to the base fabric, conventional full-width needling is accomplished with the full-width needling machine to thus insure a uniform needling throughout the working width of the felt Although the apparatus and technique disclosed in U.S. Pat. No. 4,536,927 overcomes some of the disadvantages of the earlier apparatus and techniques for providing machine direction fiber layers, it will be appreciated that with the technique and apparatus of U.S. Pat. No. 4,536,927, the full-width needling machine is idle while the longitudinally-extending spiral windings of fiber web are applied and tacked to the base fabric. This is for the reason that operation of the full-width needling device before all of the longitudinally-extending spiral windings have been applied to the base fabric would otherwise result in nonuniform needling of the spiral loops of machine direction batt, i.e., overneedling of the first applied loops and/or underneedling of the lastly applied spiral loops. Such overneedling and/or underneedling of different portions of the resulting endless felt can adversely affect the felting properties of the papermakers' felt and, thus, are undesired. On the other hand, requiring that the full-width needling machine remain idle while the spiral windings or loops of longitudinally-extending fiber batt are applied and tacked in place can adversely affect the efficiency of the plant or system for manufacturing of papermakers' felts.

More particularly in this latter regard, plants for manufacturing of papermakers' fabrics and felts traditionally include a number of different types of machines and equipment. For instance, such plants generally include a weaving loom for weaving of the base fabrics which, for example, may comprise woven monofilament mesh fabrics, a finishing machine onto which the base fabric produced on the weaving loom is placed for heat treating or setting of the woven base fabric in order to fix the size of the fabric, and a needle loom for needling fibrous material to be base fabric to fully integrate and unite the fibrous material into the base fabric. In addition, such plants also generally include a batt-making line for producing a carded fiber web or batt of narrow width, and a cross lapping apparatus for producing a cross-layered fibrous web of a width corresponding to the width of the base fabric. The cross-layed fibrous web may be applied directly from the cross lapping apparatus to the base fabric, or may first be tacked together, rolled onto a separate roll and then later unwound for being applied to the base fabric. The batt-making line may, in turn, include equipment for opening of textile fibers, equipment for blending of the fibers, and equipment for carding or orienting of the fibers to produce the carded fiber web or batt.

Needle looms are complicated, sophisticated pieces of equipment which generally have a plurality of separate needling stations, each of which is generally comprised of a plurality of juxtaposed needling units or devices mounted to a machine frame so as to extend across the working width of the machine. The needling units each include a multiplicity of needles arranged in rows and columns which are moved up and down to pierce the fiber layer applied to the endless base fabric in order to lock the fibers to the base fabric. Generally, several passes are made past the needling stations in order to fully and properly needle the fibrous layer to the base fabric. Further, when needling cross-layed fibrous webs to the base fabric, the full-width needling devices are initially operated so as to tack the cross-layed web in place (generally, by utilizing fewer needles and/or shorter strokes, but at a faster speed, i.e., a higher throughput) in order to initially hold the layed fibrous material in place. After the fibrous material has been tacked in place, the needling devices are then operated utilizing the full compliment of needles and/or at full penetration to fully lock and unite the fibrous material to the base fabric. This is accomplished, however, at a slower speed than that at which the fibers are initially tacked in place and, thus, the needle loom has a slower throughput. After complete and full needling, the endless fabric having the fiber layer needled thereon is taken off and may be placed on a finishing machine for heat-setting of the finished felts and/or for other surface treatments, such as singing, compaction, washing and/or vacuuming.

In terms of the operational process in the manufacture of endless papermakers' felts, the slowest piece of equipment and, also, the most expensive piece of equipment, is generally the needle loom. For instance, needle looms generally cost at least twice as much as finishing machines and, in some instances, almost three times as much as finishing machines. Also, in terms of the speed of operation, in present day plants, only one finishing machine is required for every two to three needle looms. That is, one finishing machine in a plant can supply finished, heat set base fabrics for two to three needle looms operating at conventional speeds and/or can finish or surface condition produced felts from two to three needling looms. Simply put, conventional needling looms are among the most expensive pieces of machinery in a papermakers' felt production plant and, also, among the slowest operating. Consequently, it is most important in order to efficiently and economically produce felts to maintain the needling looms operating at full capacity and performing their intended needling functions at all times.

However, employing a system and technique such as disclosed in U.S. Pat. No. 4,536,927, in which machine direction fiber batts are applied on and tacked to an endless base fabric while the endless web is on a conventional full-width needling loom, ties up the needling loom and removes it from being able to function in its intended manner. This is for the reason that the full-width needle loom is rendered idle during the time that the machine direction fiber batt is applied on and tacked to the endless base fabric. Here it should be noted that when the needle loom is tied up, the batt-making line also is tied up in those instances where the batt-making line is feeding cross-layed batts directly from the apron of the cross-lapping apparatus directly onto the base fabric on the needle loom. Consequently, while the system and technique disclosed in the '927 patent does result in the production of satisfactory paper machine felts, it is not accomplished in an efficient manner which takes into account the operating and production characteristics in a papermakers' felt production plants. Of course, the inefficiency resulting from the needle loom being rendered idle while fibrous material is being layed on the base fabric is more profound and significant in connection with applying machine direction fibrous batt to the endless base fabric since the needle loom cannot be used at all during the entire process of laying the fiber batt thereon. For instance, with conventional cross-layed fiber webs, the full-width needling device can be immediately operated as the batt is applied (albeit utilizing fewer needles or shorter strokes to tack the fiber batt in place) since the cross-layed batt, as it is applied or layed on the base fabric, has a width corresponding to the width of the base fabric. However, with machine direction fibrous batts applied or layed onto the base fabric on the needling loom, the full-width needling machine must remain idle during laying on of the loops of fibrous batt until all such loops have been applied to form a complete fiber layer extending across the full-width of the base fabric.

SUMMARY OF THE INVENTION

In accordance with the present invention, there is provided a method and system for manufacturing endless needled felts of the type having at least one layer of longitudinally-extending spiral windings of a fiber web which overcomes the above-discussed and other disadvantages and, in particular, which provides for full, efficient utilization of the needling looms for their intended function, thereby resulting in the efficient manufacture of papermakers' felts and the like. More particularly, in accordance with the method of the present invention, there is provided a first machine having a first support means for supporting an endless fabric and for moving an endless fabric supported thereon in a longitudinal direction. The first machine has in association therewith a web feeding device for feeding a fiber web having a width substantially less than the working width of the first machine and tacking means operatively associated with the web feeding device for tacking fiber web applied to an endless fabric supported on said first machine. There is also provided a second machine having second support means for supporting an endless fabric and for moving the fabric supported thereon in a longitudinal direction of the second machine. The second machine includes a full-width needling means for needling the fabric supported on the second support means, the full-width needling means being disposed to extend in a direction transverse to the longitudinal direction of the second machine and having a working width corresponding to the working width of the second machine. An endless fabric is initially placed on the first support means of the first machine, and the first machine is operated to move the endless fabric in the longitudinal direction of the first machine. While the endless fabric is being so moved in the longitudinal direction of the first machine, the web feeding device is reciprocated throughout the working width of the endless fabric so as to apply overlapping, longitudinally-extending spiral windings of fiber web thereon. Also, the tacking means is operated as the web feeding device is reciprocated so that the tacking means tacks the applied fiber web to the endless fabric substantially only throughout the width of the applied fiber web. After the fibrous web is applied on and tacked to the endless fabric, the endless fabric is removed from the first machine and placed on the second support means of the second machine. The second machine is then operated to move the endless fabric placed thereon in the longitudinal direction of the second machine, and the full-width needling means is operated to fully needle the tacked fiber web to the endless fabric.

In accordance with a preferred embodiment, the tacking means comprises a needling device having an operative width corresponding to the width of the fiber web applied to the endless fabric. The needling device is operative to be reciprocated in unison with the web feeding device throughout the working width of the endless fabric so as to tack the fiber web applied to the endless fabric substantially only throughout the width of the fiber web.

It will thus be appreciated that in accordance with the method of the present invention, a machine direction fibrous batt is applied and tacked to an endless base fabric on one machine, and then removed therefrom and placed on a second machine which, in the preferred embodiment, may comprise a conventional needle loom. Full needling of the layer of longitudinally-extending spiral windings of fiber web is then accomplished on the full-width needling loom. In this manner, the needling loom is efficiently utilized for its intended purpose, namely, full and complete needling of the fiber web. The needling loom is not rendered idle, as with prior art methods and apparatus, while longitudinally-extending spiral windings of fiber web are layed on the base fabric. This thus results in an increase in the efficiency of conventional needle looms in the manufacture of papermakers' felts, i.e., the rate of production of finished, fully-needled felts produced on needle looms is higher. This is for the reason that the needle looms will only be used for their intended purpose of fully needling of felts, and will not be idle during operations for laying on fibrous batts.

Also, in accordance with a preferred embodiment, the first machine may advantageously comprise a conventional finishing machine in a papermakers' fabric manufacturing plant which has been provided with a reciprocating web feeding device and narrow-width needling module, which are both operative to reciprocate in unison throughout the transverse width of the fabric on the machine. As the treatment operation performed conventionally on finishing machines is accomplished relatively quickly, at least in comparison to full and complete needling of the same size felts on conventional needling looms, the conventional finishing machine provided with the traversing web feeding device and needling module can not only heat-set the base fabric but, in addition, can be used to apply and tack machine direction batts to the base fabric, all within a time such that the needling loom can be kept fully operational for performing its intended function. In other words, within the time required for accomplishing full needling of a conventional felt, including loading and unloading of the endless fabric therefrom, the finishing machine can be used to not only heat-set base fabrics, but also can be used to apply machine direction fabric thereto and tack same in place, such that the needling loom will not be idle other than in connection with loading and unloading of fabrics therefrom. This is true even to the extent that the base fabric, after being produced on the weaving loom, may be initially loaded onto a finishing machine, heat-set, removed therefrom and placed on a needling loom for applying and needling conventional cross-layed fibrous batt thereto, then removed from the needling loom and placed on the finishing machine again for applying and tacking machine direction batt thereto, and thereafter removed from the finishing machine and reintroduced onto the needling loom for needling of the machine direction spiral loops of fiber batt. Here it should be noted that during the interval when a fabric having cross-layed needled fiber batts is removed from the needle loom and introduced onto the finishing machine for applying and tacking machine direction batts thereto, a different fabric may be introduced onto the needle loom for the purpose of applying and needling conventional cross-layed batts thereto, or another fabric having machine direction batts already applied and tacked thereto introduced onto the needle loom, and the needle loom operated for full-width, complete needling thereof.

In accordance with a further preferred embodiment of the present invention, a separate batt-producing line is provided in the plant for making machine direction carded fiber batts alone. Further, a separate machine similar in nature and construction to a conventional finishing machine, either with or without a heated roll, may be provided. While such additional equipment and apparatus does add to the cost of equipment in the papermakers' fabric production facility, such additional equipment enables full and efficient utilization of the needling loom equipment in the plant, such that the overall per fabric cost for producing of papermakers' felts and, in particular, needled felts, is less, at least in terms of the same quality of needled felts produced In accordance with the system of the present invention, separate machines are provided—one for applying and tacking of longitudinally-extending spiral windings of fiber webs to an endless base fabric, and one for fully needling of such applied/tacked fiber webs to the base fabric utilizing a full-width needling means. More particularly, the first machine has first support means for supporting an endless base fabric thereon and for moving the endless base fabric in a longitudinal direction of the first machine. A fiber web feeding device is provided in association therewith for feeding of a longitudinally-extending fiber web having a predetermined transverse width, the fiber web feeding device being disposed in relation to the first support means so as to feed, in substantially the same direction as the longitudinal direction of the first machine, a longitudinally-extending fiber web onto an endless fabric supported on the first support means as the endless fabric is moved in the longitudinal direction of the first machine. Means are provided for reciprocating the web feeding device in a direction transverse to the longitudinal direction of the first machine so as to form longitudinally-extending spiral windings of fiber web on the endless fabric. There is also provided tacking means operatively associated with the web feeding device. The tacking means is disposed in relation to the first support means and the web feeding device so as to tack fiber web applied to the endless fabric supported on the first support means substantially only throughout the width of the applied fiber web as the web feeding device is reciprocated. The second machine includes second support means for supporting an endless fabric thereon and for moving the endless fabric in a longitudinal direction of the second machine. A full-width needling machine apparatus is also provided, having a working width corresponding to the working width of the second machine. The full-width needling apparatus is disposed transversely to the longitudinal direction of the second machine so that the needling apparatus is operative to fully needle an endless fabric throughout its width as the endless fabric is moved in a longitudinal direction past the full-width needling apparatus. In this manner, the first machine is operative to apply and tack spiral windings of fiber web to the endless base fabric, and the second machine is operative to fully needle the fiber web which was applied and tacked to the endless base fabric on the first machine, thus providing for an efficient utilization of the second machine which advantageously may comprise a full-width needle loom. More particularly, in accordance with the system of the present invention, the second machine or full-width needle loom is only utilized for fully needling of a fabric mounted thereon and, in particular, is not utilized in conjunction with applying spiral windings of fiber batts thereto and/or tacking of spiral windings of a fiber batt layed on a base fabric.

BRIEF DESCRIPTION OF THE DRAWINGS

The present invention can be more fully appreciated with reference to the following detailed description, which refers to the attached drawings in which.

DETAILED DESCRIPTION OF THE PREFERRED EMBODIMENT

Figure 1:
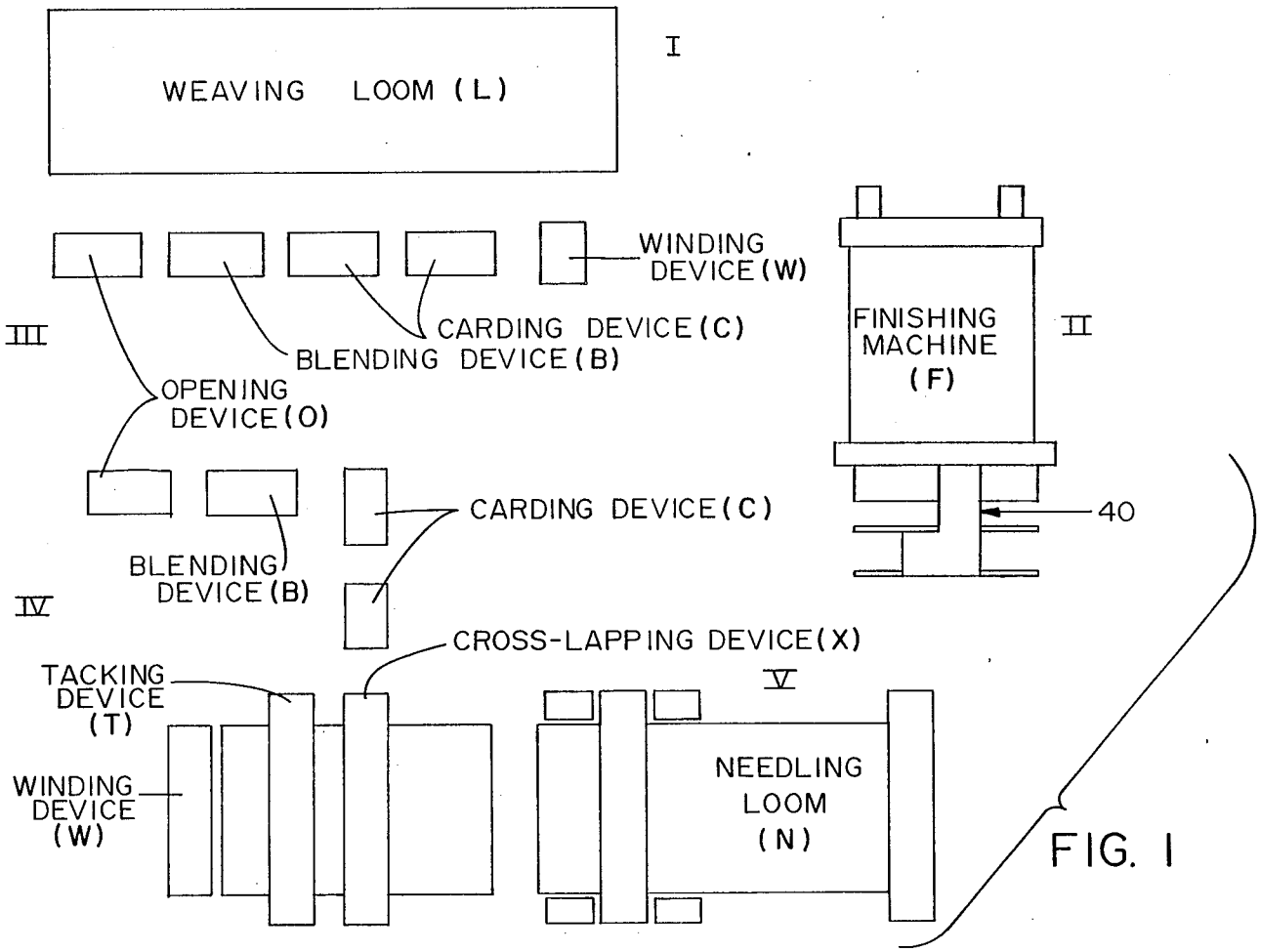
FIG. 1 is a schematic illustration of a plant layout in accordance with a preferred embodiment of the present invention for the manufacture of endless needled felts having at least one layer of longitudinally-extending spiral windings of a fiber web.

Referring now to the drawings wherein like reference characters represent like elements, there is shown in FIG. 1 a schematic illustration of a plant layout in accordance with a preferred embodiment of the present invention for the manufacture of endless needled felts of the type having at least one layer of longitudinally-extending spiral windings of a fiber web. More particularly, FIG. 1 illustrates schematically various different pieces of equipment which may be used in accordance with the method and system of the present invention for the manufacture of machine direction needled felts. It will, of course, be appreciated by those skilled in the art that FIG. 1 illustrates only one arrangement of a possible plant layout utilizing the principles of the present invention, and that other layouts, utilizing additional or even fewer pieces of equipment, could be employed without departing from the scope and spirit of the present invention. Further, it will also be appreciated that a typical plant for producing needled felts used in the paper-making industry may, and generally would include a plurality of the different types of machines or equipment illustrated in FIG. 1, although the actual number of each different type of equipment or machine may vary depending upon a number of factors, such as the size and speed of operation of the various pieces of equipment, the types of needled felts being produced, the availability of space within the facility, and the like. In this regard, as noted hereinabove, generally, one of the slowest pieces of equipment in a typical production facility for making or manufacturing needled felts is the needle loom for needling of fibrous material to an endless base fabric or web. Consequently, in typical manufacturing facilities, generally a plurality of needle looms, such as the needle loom N shown in FIG. 1, would be provided for each weaving loom L and each finishing machine F. Stated another way, a single finishing machine F generally is capable of providing a plurality of finished endless base fabrics to a needle loom N in the same amount of time that needling operations on the needle loom N require.

In the schematic illustration of FIG. 1, there are five different stations illustrated, by roman numerals I, II, III, IV and V, which each represent a different part of the manufacturing process. Station I comprises a weaving station having a weaving loom L for manufacture of woven base fabrics, such as a woven monofilament mesh. It is the endless base fabric to which fibrous material is to be needled to thus produce a finished needled felt. Station II represents a finishing station for finishing of the base fabrics produced at the weaving station I. Finishing operations are necessary for heat treating or setting of the woven base fabrics in order to fix the size of the endless fabric. The finishing station II will thus include a finishing machine F, for example, of a cantilevered beam construction having a pair of spaced-apart end rolls which receive the endless base fabric. The end rolls are adapted to be moved apart from one another in order to stretch the base fabric and move same relative to a suitable heating means, such as a hot roll, in order to stretch and heat set the base fabric to fix its dimension. The cantilever beam construction for the finishing machine is advantageous in order to permit ease of loading and unloading of the base fabric relative to the end rolls. The finishing machine may also be used, in some instances, for surface treating o the finished needled felt after fibrous material has been needled thereto, such as, for example, singing, compaction, washing, vacuuming and the like.

In FIG. 1, two types of fiber batt-making lines or stations III, IV are illustrated. Station III illustrates a batt-making line for producing the fibrous web or batt which is to be applied in the form of longitudinally-extending spiral windings onto a base fabric or other endless web, whereas Station IV illustrates a fibrous web or batt-making line for producing a cross-layed fibrous web to be applied to the base fabric. Both of the stations include suitable opening devices O for opening of textile fibers, blending devices B for blending of the fibers, and carding devices C for orienting the fibers to produce a carded batt or web. Typically, two separate carding devices C are used for properly orienting the fibers to produce the carded fiber batt or web. In each of the Stations III and IV, the resulting carded fiber batt or web has a relatively narrow width. In Station III, the produced carded fiber batt or web is simply wound by means of a winding device W onto a roll which may then be transferred and used subsequently for applying longitudinally extending spiral windings on an endless web, as described more fully hereinbelow. In Station IV, the produced carded fiber web is directed to a cross lapping apparatus X for producing a cross-layed fibrous web having a width corresponding to the width of the base fabric to which the fibrous material is to be applied. As is well-known, in the cross lapping apparatus X, the carded fiber web is supplied to a feeding device which reciprocates transversely over a longitudinally-moving floor apron to thereby form a longitudinally-extending web having folded cross-layed layers of fibrous material. The cross-layed fibrous material may be fed directly from the floor apron onto an endless base fabric on a needle loom N. Alternatively, the cross lapping apparatus X may be provided with a tacking device T for tacking together the cross-layed fibrous material, which may then be wound onto rolls by means of a winding device W, the wound rolls then being transferred and used subsequently to apply the cross-layed web onto an endless base fabric as needed.

In Station V, there is provided a full-width needle loom or apparatus N for needling of an endless felt to which fibrous material has been applied to thereby incorporate and unite the fibrous material to the base fabric. The needle loom N, as is conventional, includes a full-width needling means extending transversely across the entire width of the loom, as well as a plurality of spaced rolls on which the endless fabric is supported. One of the rolls is a drive roll and serves to move the web relative to the transversely extending needling means, which is operative to needle the fibrous material into the base fabric to fully lock and unite the fibrous material thereto. The endless base fabric is driven in this manner until the entire quantity of fibrous material applied thereto is moved past the needling means the required number of passes to insure that the fibrous material is fully incorporated and united to the base fabric.

In accordance with a preferred embodiment of the present invention, longitudinally-extending spiral loops 12 of fibrous batt for producing machine direction oriented fibers are initially applied on and tacked to an endless web 10 on a finishing machine, such as the finishing machine F at Station II as shown in FIG. 1. The endless web 10 may comprise any type of endless web to which fibrous material is to be united, such as an endless backing fabric which does not have any other fibrous material applied thereto or one which has one or more layers of fibrous material, either machine direction or cross lapped, previously applied thereto. Still further, the endless web may be made up of spiral windings or loops of fibrous materials joined together such as by tacking (i.e., an endless web without any backing fabric). The endless web 10 having the longitudinally-extending spiral loops 12 of fibrous batt tacked thereto is then removed from the finishing machine F and loaded onto the full-width needle loom N which is then operated to fully and completely needle the tacked fibrous material to the endless web 10. Alternatively, a separate machine which is like a finishing machine, in terms of having a pair of spaced rolls for supporting and moving an endless fabric in a longitudinal direction, but which is not used for finishing operations of endless fabrics, may be used for applying and tacking longitudinally-extending spiral loops of fiber batt to the endless base fabric. The important thing to appreciate is that, in accordance with the present invention, the layer of longitudinally-extending spiral loops 12 of fiber web or batt are applied on and tacked to an underlying endless web 10 on a machine different from the full-width needling loom N, with the full-width needling loom N instead being used solely for full-width needling of applied and tacked fiber web to an underlying endless web 10.

In this manner, a more efficient utilization of equipment and manufacturing operations are provided for producing endless needled felts having machine direction oriented fibers. In particular, the generally more expensive and slower running equipment, i.e., the needle loom N, is only utilized for its intended function of fully needling fibrous material to an underlying endless web and, in particular, does not remain idle during the applying and tacking of longitudinally-extending spiral windings R of fibrous material to the underlying endless web 10. Instead, a less costly piece of equipment is utilized for the relatively slow operation of applying longitudinally-extending spiral windings R of fibrous material on an endless web 10 and tacking of same in place thereon prior to introduction of the endless web 10 having the applied/tacked fibrous material thereon onto the needle loom N for full-width needling to complete the incorporation and uniting of the fibrous material to the endless web 10.

Figure 2:
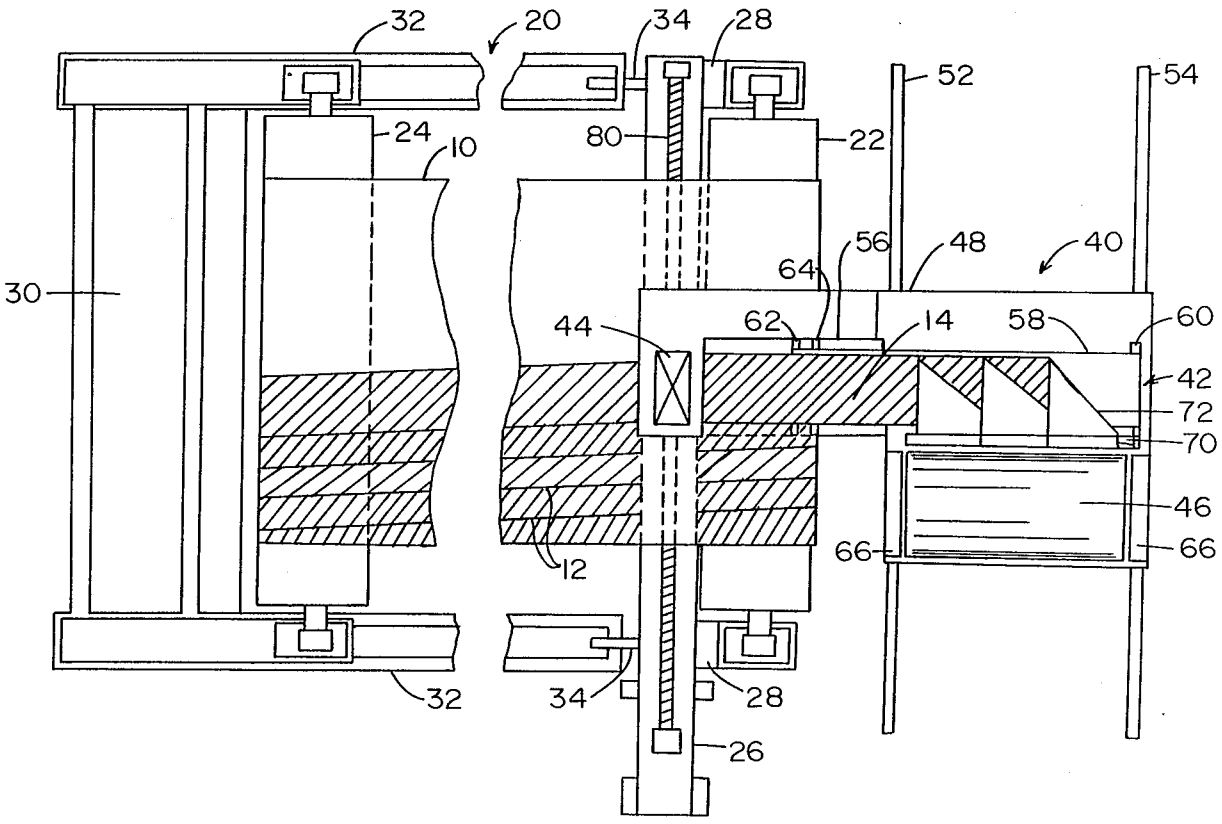
FIG. 2 is a schematic plan view of a first machine in accordance with the method and system of the present invention which is used for applying and tacking of spiral windings of a fiber web onto a base fabric.
Figure 3:
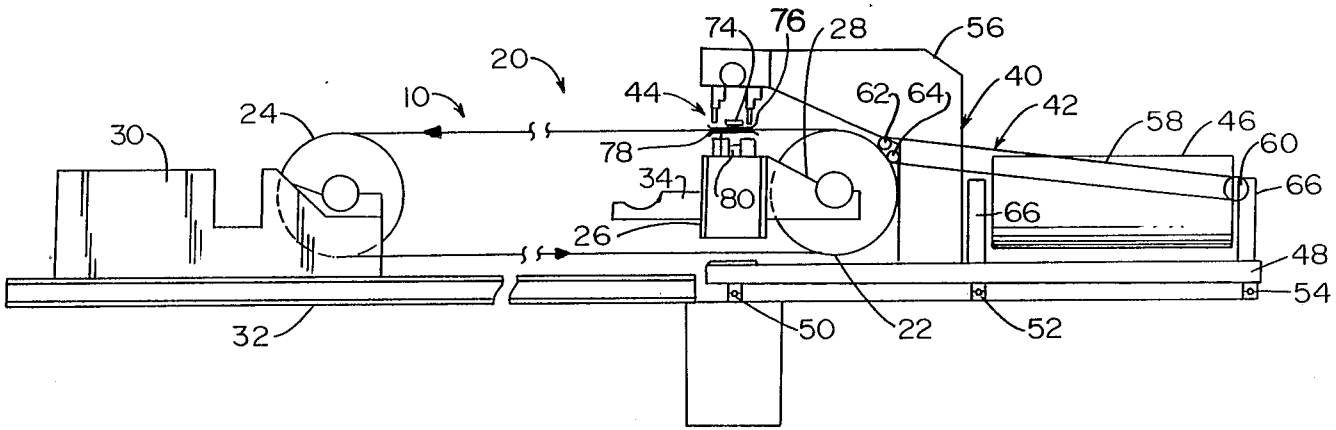
FIG. 3 is a schematic side elevational view of the apparatus shown in FIG. 2.

More particularly, referring to FIGS. 2 and 3, there is illustrated an endless web support machine or apparatus 20 to be used for applying and tacking of at least one layer of longitudinally-extending spiral windings 12 of a fiber web 14 to an underlying endless web 10 and which preferably may comprise or be of a construction corresponding to a conventional finishing machine used in the papermakers' clothing industry. The web support machine 20 includes a pair of parallel end rolls 22, 24 which are adapted to be moved apart from one another for supporting an endless web 10 to which longitudinally-extending spiral windings 12 of fibrous material are to be applied and tacked. In the preferred embodiment shown in FIG. 2, end roll 22 is supported at its opposite ends from a transversely-extending cantilevered beam 26, by means of suitable brackets or yokes 28 extending from the side thereof. The other end roll 24 is carried at its opposite ends by means of a carriage structure 30 adapted to move along spaced support rails 32 which extend in a direction toward and away from the cantilever beam 26. The cantilevered beam 26 as is typical in finishing machines, is supported at one end from the floor of the plant and extends above the floor across the width of the apparatus 20. The free end of the beam 26 may be temporarily supported by suitable means (not shown).

The cantilevered beam 26 includes temporary support yokes 34 on the side opposite the yokes 28 for temporarily holding the movable end roll 24 therefrom. This type of cantilever support arrangement serves to facilitate removal and introduction of endless webs 10 onto the apparatus 20 by virtue of the one end of the cantilever beam 26 being free and spaced from the floor of the plant and by virtue of the fact that both rolls 22, 24 are supported thereon. More particularly, with both end rolls 22, 24 supported from the cantilevered beam 26, an endless web 10, in a slackened condition, may be introduced over the end rolls 22, 24. The carriage 30 for the movable support roll 24 is brought into position to receive the movable roll 24 and the roll 24 transferred to the carriage 30, which is then driven in a direction along tracks 32 away from the first roll 22 to support the endless web 10 in a taut condition. Suitable means are provided for driving at least one of the rolls, such as the roll 24 supported on the carriage 30, in order to move the endless web 10 in a longitudinal direction relative to the transversely-extending cantilevered beam 26, e.g., so that the upper run of the endless web 10 moves in a direction from right to left as shown in FIGS. 2 and 3, and the lower run moves in the opposite direction beneath the lower extent of the cantilever beam 26.

In order to apply and tack longitudinally-extending spiral windings 12 of fibrous batt 14 to the endless web 10, in accordance with a preferred embodiment of the present invention, there is provided in association with the web support machine 20, a web feeding/needling apparatus 40 which is adapted to reciprocate transversely relative to the endless web 10. The web feeding-/needling apparatus 40 includes a fiber web or batt feeding device 42 and a small-width needling module 44. The web feeding device 42 serves to convey a narrow-width batt 14 of fibrous material from a suitable supply source 46 to a position overlying a portion of the upper run of the endless web 10 carried by the web support machine 20. As the endless web 10 is moved, the fiber batt 14 is deposited onto the surface of the endless web 10 and moves beneath the narrow-width needling module 44 which serves to needle or tack the applied fiber batt 14 to the surface of the endless web 10. The web feeding/needling apparatus 40 is reciprocated throughout the width of the endless web 10 so as to apply generally longitudinally-extending spiral loops or windings 12 of fibrous batt 14 onto the surface of the endless web 10, i.e., the spiral loops or windings 12 extend substantially in the longitudinal direction of movement of the endless web 10 and have a pitch in the transverse direction.

More particularly, referring to FIGS. 2 and 3, the web feeding/needling apparatus 40 includes a transversely movable platform 48 on which the fiber web feeding device 42 and needling module 44 are supported. The platform 48 is adapted to be moved transversely relative to the endless web 10 along a set of three spaced-apart parallel track sections 50, 52, 54, one 50 of which underlies the transversely-extending cantilever beam 26 of the endless web support machine 20 and the other two 52, 54 of which are positioned to one side of the stationary support roll 22 of the web support machine 20. The movable platform 48 includes an upstanding, cantilevered frame 56 which is arranged so as to be located to one side of the stationary support roll 22 and extend thereover with the cantilevered end overlying the cantilevered beam 26 of the endless web support machine 20. The web feeding device 42 includes a conveyor 58 supported by conveyor rolls 60, 62, 64, one 60 arranged adjacent the remote side of the platform 48 and the others 62, 64 supported from the upstanding cantilevered frame 56 so as to be adjacent to a portion of the surface of the stationary roll 22 of the support machine 20. Upstanding supports 66 are provided on the platform 48 to one side of the conveyor 58 for supporting a roll 46 of carded fibrous material (such as a fibrous batt produced at Station III, see FIG. 1), with the axis of the roll 46 being substantially parallel to the run of the conveyor 58. The fibrous batt is fed from the roll 46 through web-splitting means 70 and about 90° turning means 72 so as to split the batt into a plurality of narrower-width webs 14, namely three in the embodiment shown in FIGS. 2 and 3, and then turn same so as to overlie each other on top of the conveyor 58. The conveyor 58 then feeds the overlying narrow-width layers 14 in a direction substantially corresponding to the direction of longitudinal movement of the endless web 10 so as to be deposited onto the surface of the endless web 10 as it is moved by the support machine 20. As the endless web 10 is moved, the platform 48 reciprocates throughout the width of the support machine 20 to thus form longitudinally-extending spiral loops 12 or windings of fiber batt 14 on the endless web 10.

Of course, the roll 46 of fiber batt could be supported on the platform 48 so as to feed fiber material therefrom in a generally longitudinal direction, in which event the turning means 72 would not be necessary. Also, splitting of the fiber batt along the longitudinal length thereof and/or layering of same is not necessary, depending upon the thickness and/or width of the fiber layers 14 which are desired to be applied and tacked to the endless web 10. In other words, a single fiberous web could be fed directly from a narrow width carding device. Further, a stationary carding device could be utilized which would feed a fibrous web to a conveyor device which may have a 90% turning arrangement on a movable carriage. Thus, it will be appreciated that many different arrangements for the web feeding device could be utilized.

Figures 4, 5:
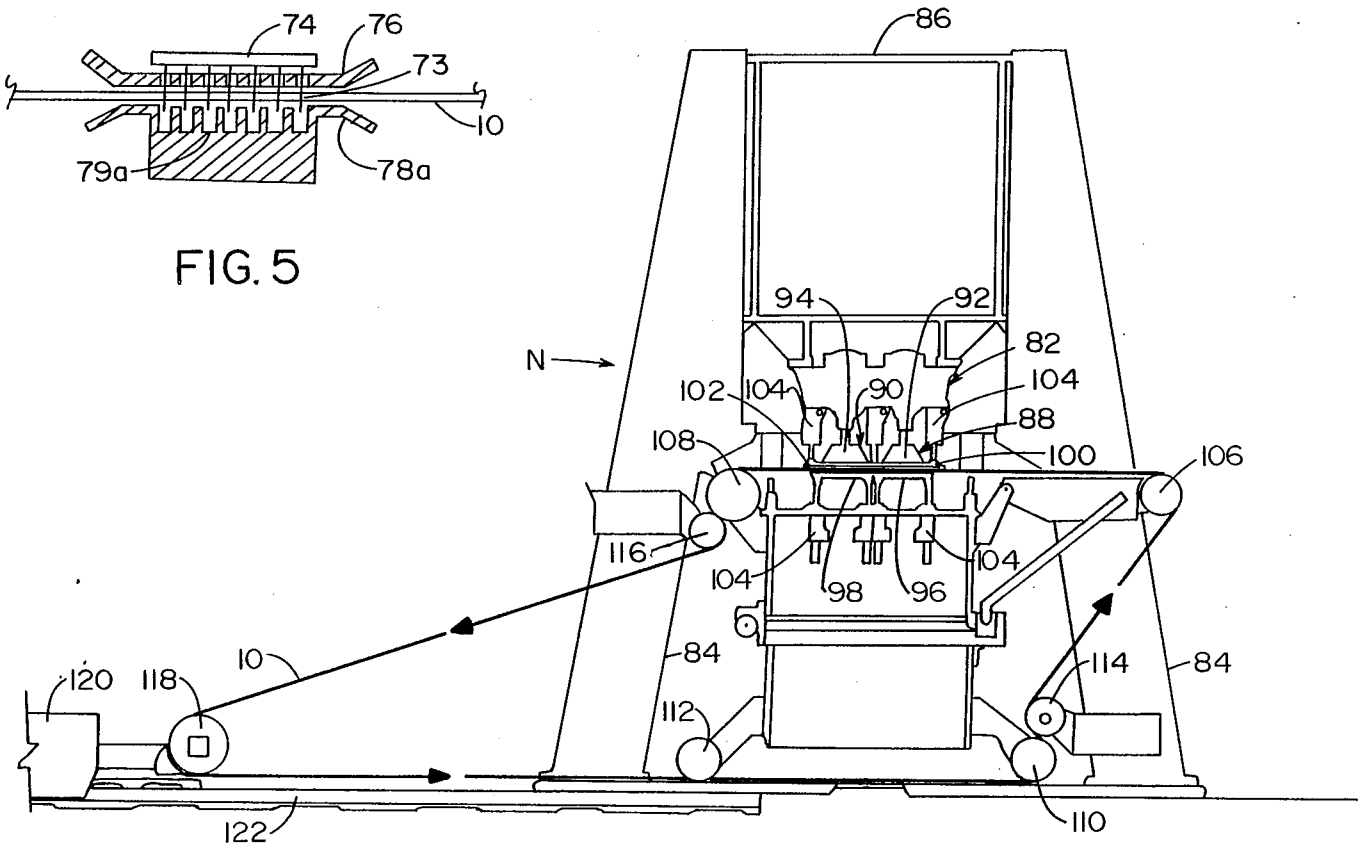
FIG. 4 is a schematic side elevational view of a needling loom which may be utilized in accordance with the present invention for fully needling of fibrous layers applied and tacked to an endless fabric on a different machine.
FIG. 5 is a side cross-sectional view of a alternative embodiment for a bed plate for use in connection with a traversing needling module such as that illustrated in FIGS. 2 and 3.

In the preferred embodiment, the small-width needling module 44 is supported from the free end of the cantilevered section of the frame 56 so as to overlie the cantilevered beam 26 of the support machine 20 and to be in alignment with the deposited fiber batt 14. As is well-known, the needling module 44 may include a plurality of barbed needles 73 carried by a driven needle board 74, the needle board 74 being driven by suitable means, for example, mounted on the frame 56, to move the barbed needles up and down to thereby needle fibrous material passing therebeneath the endless web 10. In this regard, the needling device may include a vertically-adjustable stripper plate 76 which cooperates with the needles 73 of the needle board 74 during its operation, as well as an adjustable table or bed plate 78 supported beneath the endless web 10 for supporting the endless web 10 during a needling operation. In this regard, as is known, the bed plate 78 preferably includes a plurality of holes therein in alignment with the needles 73 on the needle board 74. Also, a suitable drive mechanism, such as a feed screw 80, may be provided for moving the bed plate 78 in synchronism with movement of the needling board 74 as the platform 48 is reciprocated transversely of the endless web 10. Conveniently, the feed screw 80 may be supported on the cantilevered beam 26 of the support machine 20. Alternatively, the bed plate 78 may instead comprise a full-width bed plate **78*a* having continuous slots 79*a* extending transversely of the width of the cantilevered beam 26. Such an arrangement is shown in FIG. 5. In this instance, the bed plate 78*a* is not mounted for transverse movement relative to the cantilevered beam 26, but remains stationary and extends across the full-width of the support machine 20. In this manner, the needles 73 may enter the transverse slots or grooves 79*a*, and the bed plate 78*a* need not be moved in synchronization with the needle board 74. The bed plate 78*a* would thus be supported only for vertical movement to move same into position beneath the endless web 10** during a needling operation.

Although a reciprocating needling module 44 is utilized in the preferred embodiment for tacking of applied fiber batt 14, it should be appreciated that other types of tacking arrangements or means could be utilized. For instance, a full-width sequentially-operated tacking device such as shown and described in copending application Ser. No. 096,613, filed Sept. 14, 1987, now U.S. Pat. No. 4,777,706 granted Oct. 18, 1988, and entitled "Apparatus For Manufacturing Endless Needled Paper Machine Felts", could be utilized in conjunction with the endless web support machine 20. As more fully described in such copending application Ser. No. 096,613, which is hereby incorporated by reference, the tacking means comprises a full-width needling mechanism which includes a plurality of adjacent needling units each of which are actuable between a needling position and a non-needling position. Means are provided associated with each of the needling units and correlated to the position of a web feeding device for selectively actuating corresponding ones of the needle units to needle applied fiber web fed from the web feeding device. In this regard, the tacking portion of the needling mechanism (i.e., the actuated needling units) effectively follows the web feeding device as it is reciprocated so that the fiber web applied to the endless fabric is tacked substantially only throughout the width of the applied fiber web.

It will thus be appreciated that the endless web support machine 20 and web feeding/tacking apparatus 40 shown in FIGS. 2 and 3 is operative to apply at least one layer of longitudinally-extending fibrous batt 14 onto an underlying endless web 10 in the form of spiral loops 12 or windings 12 and to then tack such layed batt 14 in place thereon. This is accomplished by supporting the endless web 10 on the support machine 20, and then operating the drive roll 24 thereof to cause the endless web 10 to move in a longitudinal direction about the spaced end rolls 22, 24. As the endless web 10 is being moved, fibrous batt 14 is fed from a suitable supply 46 onto conveying means 58 which feeds the batt 14 in a generally longitudinal direction to the surface of the endless web 10 in substantially continuous manner. As the fibrous batt 14 is deposited onto the endless web 10, movement of the endless web 10 brings the layed batt 14 beneath the needling module 44 which serves to needle or tack the layed batt 14 to the endless web 10. In this regard, a relatively light tacking is provided, only enough to hold the layed batt 14 in place so that the endless web 10 with the tacked batt thereon can subsequently be removed from the support machine 20 and placed on a full-width needle loom N for full and complete needling. During this operation, the web feeding/tacking apparatus 40 is reciprocated throughout the full-width of the endless web 10 so that a series of generally longitudinally-extending spiral windings 12 of layed batt 14 are applied and tacked to the endless web 10. It will be appreciated that the reciprocating operation generally is carried out at a much slower speed relative to the speed of movement of the endless web 10 so that there is onlY a small transverse pitch. Also, the reciprocation is carried out in order to lay and tack the desired number of layers of fiber batt 14 on the endless web 10. Further, it will be appreciated that use of the splitting means 70 shown in the embodiment of FIGS. 2 and 3 permits three layers of relatively thin batt to be introduced onto the endless web 10 and tacked in place substantially simultaneously. In some instances, this may be preferred whereas, in other instances, only a single layer of batt may be applied.

Referring now to FIG. 4, there is illustrated a second machine N for completing the incorporation and uniting of the fibrous material to the endless web 10 to produce a needled felt. The second machine preferably comprises a conventional needle loom N having a full-width needling means 82 operative to fully and completely needle the longitudinally-extending spiral windings 12 that have been applied to the endless base fabric or other endless web 10 on the web support machine 20. As shown in FIG. 4, the second machine N includes a first pair of longitudinally-spaced loom support legs 84 which support one end of an elevated, rectangular loom support frame 86. The other end of the loom support frame 86 is supported by a similar pair of longitudinally-spaced loom support legs similar to legs 84. The loom support frame 86 spans the entire width of the needle loom N and supports a transversely-extending needling mechanism 82. As is conventional, the needling mechanism 82 may be comprised of interconnected commonly driven small-width needling units or modules which are juxtaposed and supported from the frame 86 in a row or rows extending transversely across the entire width of the apparatus N. In the needle loom N shown in FIG. 4, two such rows of interconnected commonly driven needling units 88, 90 are shown, each of which includes a needle board 92, 94 which carries a plurality of barbed needles. Vertically adjustable tables 96, 98 are provided below the needle boards 92, 94 for supporting a stretch of the endless fabric 10 during the full-width needling operation. AdditionallY, vertically adjustable stripper plates 92, 94 cooperate with the needles of the needle boards 92, 94 during this operation, in accordance with conventional practice. The adjustable tables 96, 98 and stripper plates 100, 102 may be raised and lowered through the use of screw jacks 104, as is conventional.

The endless fabric 10 to be needled is threaded into or loaded onto the needle loom N so as to follow an endless path defined by rollers 10 and 108 at the elevation of the needling mechanisms 88, 90, rollers 110 and 112 at an elevation slightly above the floor of the plant and suitable tensioning rollers 114, 116 as well as a roller 118 on a loom and tension unit 120. The loom and tension unit 120 is mounted on tracks, one of which is shown at 122, to facilitate movement of the unit 120 toward and away from the needling mechanism 82 for loading and unloading of the fabric 10 from the apparatus N as well as tensioning of the endless web or fabric 10 during the needling operation. One of the rollers, such as roller 110, is preferably driven in a suitable manner, such as by a motor (not shown), in order to drive the endless fabric 10 through its endless circuit or path. The tensioning rollers 114, 116 serve to tension the web 10 and insure sufficient contact between the fabric 10 and the drive roll 110. Of course, one or more of the remaining rollers may also be driven if so desired.

In accordance with the method and system of the present invention, after longitudinally-extending spiral windings 12 of fiber batt 14 are applied and tacked to an endless web 10 on the finishing machine 20, or like apparatus, separate and apart from the needle loom N, the endless web 10, with the spiral windings 12 thereon is removed and thereafter placed on the needle loom N. The needle loom N is then operated in a conventional manner to fully and completely needle the spiral windings 12 of fiber batt 14 to the underlying endless web 10 in order to fully incorporate and lock the fibrous material to the web 10 to produce a finished needle felt having machine direction oriented fibers. This is accomplished by threading the endless web 10 with the spiral windings 12 of fiber batt 14 thereon onto the needle loom N, threading the endless web about the various rolls 106–118 and moving the loom and tensioning unit 120 in a direction away from the needling mechanism 82 to place the web 10 in a taut condition. The endless web 10 is then driven in a conventional manner and the full-width needling mechanism 82 operated in a conventional manner to fully and completely needle the fibrous material to the underlying endless web 10. This operation continues until the entire length of endless web 10 has the fibrous batt 14 fully needled thereto along its entire length. Depending upon the speed of operation of the needling operations, the number of needles used, and the amount of needling required to fully lock the fibrous material to the underlying web 10, a number of passes past the needling mechanism 82 may be required. Further, it will be appreciated that additional full-width needling mechanisms may be provided on the needle loom N in addition to the double needling mechanism unit shown in FIG. 4.

After completion of full-width needling of the fibrous material to the endless web 10, the endless web 10 is removed from the needle loom N and then subjected to further operations, as is conventional. Such further operations may include the needling of additional layers of fibrous material to the endless web 10 and/or surface conditioning and/or other heat treating operations with respect to the needled felt. These additional operations generally are accomplished on other machines, thus freeing up the needle loom N for full-width needling of additional fabrics.

In this regard, it will be appreciated that in accordance with the method and system of the present invention, the needle loom N is only used for its main intended function of full-width needling of endless fabrics 10 to produce needled felts and, in particular, is not used or employed in connection with operations for applying and/or tacking of longitudinally-extending spiral windings 12 of fiber batt 14 to a base fabric 10 during which the full-width needling means 82 thereof is not utilized. Here it should be noted that full-width needle looms generally have a relatively low throughput in comparison to other pieces of equipment in a papermakers' felt manufacturing plant. This is due, in part, to the fact that the speed of movement of the endless felt on a needle loom N is relatively slow in comparison to the speed of travel on other pieces of equipment utilized in the manufacture of needled felts, such as finishing machines F and/or weaving looms L.

More particularly, needle looms, such as needle loom N, are typically capable of operating for full-width needling at a rate of 5–6 feet per minute when applying cross lapped fibrous webs directly from a cross lapping apparatus, and on the order of 10–12 feet per minute utilizing pretacked cross lapped batts unwound from a roll. With the present invention in which a web feeding-/tacking apparatus 40 is employed in conjunction with a finishing machine F or like apparatus 20 for applying and tacking of longitudinally-extending spiral windings or loops 12 of fibrous batt 14, the speed of the applying and tacking operation on the finishing machine F or 20 would be on the order of a maximum of 30 feet Q per minute. Full-width needling of a base fabric 10 having such longitudinally-extending spiral windings 12 of fiber batt 14 pretacked thereto could be accomplished at a rate of 12 to 18 feet per minute on the needle loom N. Both of these operations, for different fabrics, can be performed at the same time.

If the web feeding/tacking apparatus 40 were instead used in conjunction with the needle loom N, such as contemplated in accordance with U.S. Pat. No. 4,536,927, in which the longitudinally-extending spiral windings of fiber batt must initially be applied and tacked to the underlying base fabric on the needle loom itself, the needle loom N would remain idle, and thus not capable of being used for its intended function during the applying and tacking operation. This would not only tie up the needle loom N, but also, would tie up and render idle the various other components and pieces of equipment used in the plant such as, for example, the various batt-making lines, cross lapping apparatus and the like. It thus minimizes the overall efficiency of the plant and/or requires the purchase of additional needle looms, which are among the most expensive items of equipment in a needled felt-producing plant.

Further, because of the relative speeds of operation, generally in felt manufacturing plants, 2–3 full-width needle looms N are provided for each finishing machine F used in the production of needled felts. In order to provide for a more efficient utilization of equipment and manufacturing operations in accordance with the present invention, it would only be necessary to provide an additional web feeding/tacking apparatus 40 for use in conjunction with a finishing machine F (or one of the finishing machines if several were provided) or, possibly, provide an additional finishing-type machine which is significantly less expensive than the purchase of additional needle looms N. Also, an additional batt-making line may be provided or converted if several batt-making lines are already provided in the plant. Still further, it is possible to convert an outdated and presently not used piece of finishing-type of equipment with little relative additional expense to provide a separate apparatus for applying and tacking of longitudinally-extending spiral windings of fiber batt onto an underlying endless web. It will thus be appreciated by those skilled in the art that many such options are available utilizing the principles in accordance with the present invention, depending upon the number of pieces of equipment in the plant, available space, etc. The overall aim is to only use the needle looms for their intended function, namely, full-width needling operations.

Also in accordance with the present invention, advantageously, one of the rolls of the web support machine or apparatus 20 may include a hot oil heated roll (such as roll 22), as is generally conventional in typical finishing machines, for heat setting of the base fabrics, while at the same time utilizing the web feeding/tacking apparatus 40 in conjunction therewith, thus providing additional efficiency in utilization of equipment and manufacturing operations. Still further, it will be appreciated that instead of utilizing a roll 46 of fiber batt as the supply of fiber material in conjunction with the web support machine 20 for applying and tacking longitudinally-extending spiral windings 12 of fiber batt 14 onto an endless web 10, the fiber batt could be supplied directly from one of the carding devices C of a batt-making line, through the use of various conveying means and the like. In this instance, the output from the carding device C would be directed to the conveying means 58 on the platform 48, thus eliminating the necessity of a winding apparatus W in conjunction with the batt-making line to provide rolls of fiber batt. Again, this would be dependent upon the particular operations and equipment in a needled felt manufacturing plant.

As will be readily apparent to those skilled in the art, the present invention may be used in other specific forms without departing from its spirit or essential characteristics. The preferred embodiments are therefore to be considered as illustrative and not restrictive, the scope of the invention being indicated by the claims rather than the foregoing description, and all changes which come with the meaning or range of equivalents of the claims are therefore intended to be embraced therein.

What I claim is:

1. A method of manufacturing endless needled felts having at least one layer of longitudinally-extending spiral windings of a fiber web, said method comprising the steps of:

providing a first machine having first support means for supporting an endless fabric and for moving a fabric supported thereon in a longitudinal direction of said first machine, said first machine having in association therewith a web feeding device for feeding a fiber web having a width substantially less than the working width of said first machine and tacking means operatively associated with said web feeding device for tacking fiber web applied to an endless fabric supported on said first machine, and said first machine having no separate full-width needling means which is operable to perform full-width needling of an endless fabric supported on said first machine;

providing a second machine having second support means for supporting an endless fabric and for moving a fabric supported thereon in a longitudinal direction of said second machine, said second machine including full-width needling means for needling a fabric supported on said second support means, said full-width needling means being disposed to extend in a direction transverse to said longitudinal direction of said second machine and having a working width corresponding to the working width of said second machine, and said second machine having no web feeding device for feeding onto an endless fabric supported on said second machine longitudinally extending spiral windings of a fiber web which has a width substantially less than the width of endless felts to be produced;

placing an endless fabric on said first support means and operating said first machine to move said endless fabric in said longitudinal direction of said first machine;

while said endless fabric is being moved in said longitudinal direction of said first machine, reciprocating said web feeding device throughout the working width of said endless fabric so as to apply overlapping longitudinally extending spiral windings of said fiber web on said endless fabric;

operating said tacking means as said web feeding device is reciprocated so that said tacking means tacks said fiber web applied to said endless fabric substantially only throughout the width of said applied fiber web;

removing from said first machine said endless fabric having said fiber web tacked thereto;

placing said removed endless fabric having said tacked fiber web onto said second support means of said second machine and operating said second machine to move said endless fabric placed thereon in said longitudinal direction of said second machine; and operating said full-width needling means of said second machine as said fabric is being moved in said longitudinal direction of said second machine to fully needle said tacked fiber web to said endless fabric.

2. The method of claim 1 wherein said tacking means provides an operative tacking portion having a width substantially corresponding to the width of said fiber web fed by said web feeding device and wherein said tacking means is operative to cause said operative tacking portion to be correlated to the position of said web feeding device as said web feeding device is reciprocated so that said operative tacking portion is in alignment with said fiber web applied to said endless fabric.

3. The method of claim 2, wherein said tacking means comprises a needling device having an operative width corresponding to the width of said fiber web, said needling device being operative to be reciprocated in unison with said web feeding device throughout the working width of said endless fabric to thereby tack to said endless fabric said fiber web applied to said endless fabric by said web feeding device.

4. The method of claim 3, wherein said web feeding and needling devices are operated with respect to a first endless web placed on said first machine while said full-width needling machine is operated with respect to a second endless web placed on said second machine.

5. The method of claim 1 wherein said first machine is a finishing machine having treating means operative to treat an endless fabric supported by said first support means, and wherein said method comprises the further step of operating said treating means to treat an endless fabric while said endless fabric is being moved in the longitudinal direction of said first machine and said web feeding device and said tacking means are operated to apply and tack said fiber web to said endless fabric.

6. The method of claim 5 wherein said treating means comprises a heated roll about which said endless fabric is moved in said longitudinal direction of said first machine.

7. The method of claim 1 wherein said first machine is a finishing machine used in the manufacture of papermakers' needled felts and said second machine is a needle loom used in the manufacture of papermakers' felts.

* * * * *